United States Patent [19]

McCreadie et al.

[11] Patent Number: 4,655,302

[45] Date of Patent: Apr. 7, 1987

[54] ROTATING COUPLING

[75] Inventors: Thomas McCreadie, Montrose; James B. Mason, Dundee, both of Scotland

[73] Assignee: Hughes Tool Company, Houston, Tex.

[21] Appl. No.: 775,450

[22] Filed: Sep. 12, 1985

[30] Foreign Application Priority Data

Sep. 14, 1984 [GB] United Kingdom ..... 8423290

[51] Int. Cl.[4] ..... E21B 17/02

[52] U.S. Cl. ..... 175/218; 166/339; 173/57

[58] Field of Search ..... 166/339, 341; 175/218, 175/52, 85; 173/57, 147; 285/275

[56] References Cited

U.S. PATENT DOCUMENTS

| | | | |
|---|---|---|---|
| 3,433,252 | 3/1969 | Kennard | 137/496 |
| 3,857,450 | 12/1974 | Guier | 175/85 |
| 3,915,243 | 10/1975 | Hisey et al. | 173/147 |
| 3,915,244 | 10/1975 | Brown | 175/85 |
| 4,037,672 | 7/1977 | Hodge | 175/85 |
| 4,161,990 | 7/1979 | Forsberg et al. | 173/147 |
| 4,413,844 | 11/1983 | N'Guyen Duc et al. | 285/275 |
| 4,416,337 | 11/1983 | Phillips et al. | 173/57 |

*Primary Examiner*—Stephen J. Novosad
*Assistant Examiner*—William P. Neuder
*Attorney, Agent, or Firm*—Ratner & Prestia

[57] ABSTRACT

There is described a coupling for in use lifting and supporting oil drilling strings while allowing rotation of the drill strike and calculation of mud through the drill. The coupling comprises an upper body and a lower body. The lower body is rotatably mounted on the upper body and has support means for lifting drill pipes. The coupling is provided with a through passage for supply of mud to the drill pipes and a valve member is provided to control mud supply.

9 Claims, 3 Drawing Figures

ROTATING COUPLING

This invention relates to a rotating coupling for use in offshore drilling applications.

This type of coupling is used for lifting and supporting drill strings whilst allowing rotation of the drill string and the circulation of mud through the drill.

According to the present invention there is provided a coupling for use in offshore drilling applications comprising an upper body and a lower body rotatably mounted on the upper body, the lower body having support means for lifting drill pipes, the coupling having a through passage for the supply of mud to the drill pipes and a valve member being provided to control the mud supply.

Preferably the valve member is in the form of a check valve mounted in a through bore of the upper body, the valve being designed to open when the mud pressure drop across the valve exceeds 100 PSI.

An integral positive spring return seal may be provided in the valve to ensure that the valve closes when the mud pressure is reduced to zero.

Preferably also the support means for lifting the drill pipes is in the form of a dog mounted on the lower body and rotatable between a first position in which it is in gripping contact with a drill pipe to be lifted and a second position in which it is spaced apart from said drill pipe.

Most preferably four dogs are provided arranged such that in their first position they are in contact with the drill pipe so as to spread the load over 320° of the diameter of the drill pipe.

Preferably the dogs are each actuated by a corresponding pneumatically operated cylinder.

Preferably also the lower body is rotatably mounted on the upper body by one spherical thrust bearing and one angular contact bearing.

Preferably also two lip tight elastomeric seals are provided in the lower body to seal the lower body to the drill pipe being lifted to prevent the leakage of mud.

A number of other seals may be provided to ensure sealing between the various parts of the coupling.

An embodiment of the present invention will now be described, by way of example, with reference to the accompanying drawings, in which.

Figure 1:
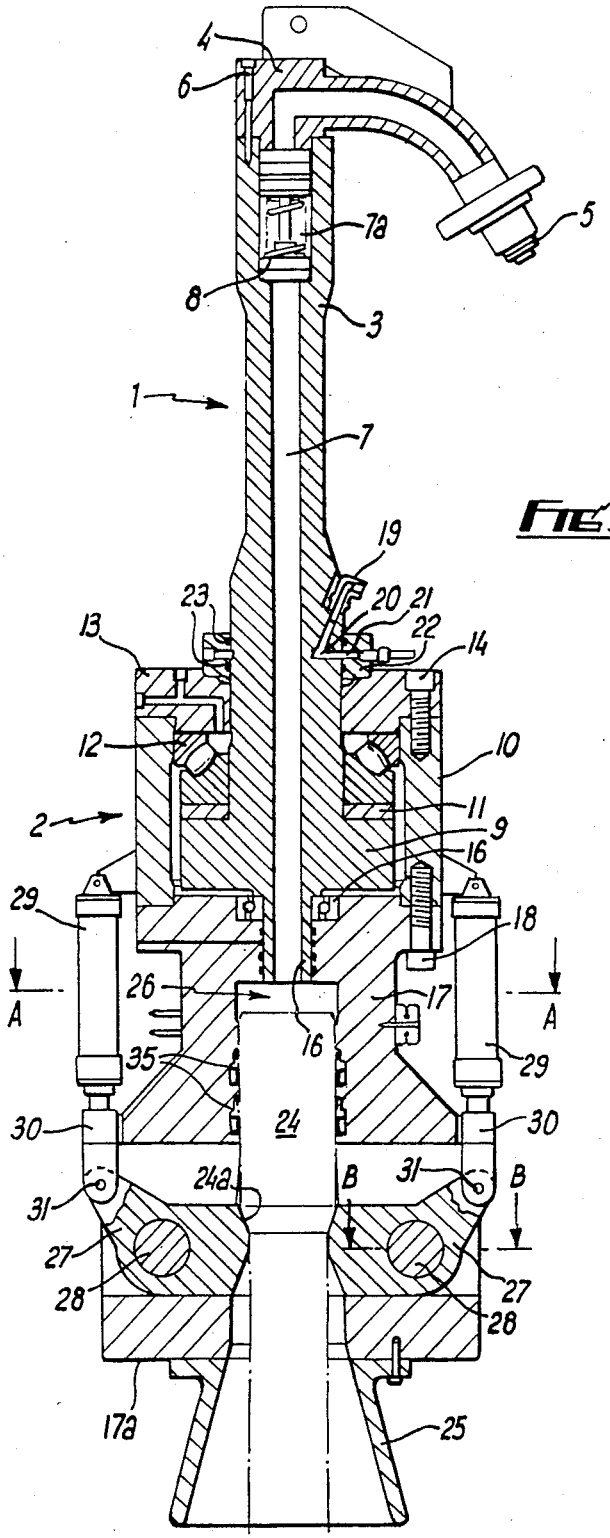
FIG. 1 is a sectional side view of a rotating coupling made in accordance with the present invention.

Referring to the drawings, a rotating coupling for supporting drill strings consists of a stationary upper body 1 and a rotatable lower body assembly 2.

The upper body 1 comprises a main body section 3 to which an end cap 4, having a mud line connection 5, is attached by cap screws 6. The main body 3 has a through bore 7 for drilling mud supply an enlarged portion 7*a* of which contains a valve 8 in the form of a drop in float valve. The valve 8 is retained in position by the end cap 4.

The lower part of the upper body 1 has a lifting shoulder 9 which provides support for the lower body assembly 2.

The upper part of the lower body assembly 2 is in the form of a casing 10 into which the lower part of the upper body 1 and the shoulder 9 fit. A spacer 11 is affixed to the upper body 1 between the shoulder 9 and a spherical roller bearing 12. A retaining cap 13 is affixed to the casing 10 by cap screws 14 and serves to retain the lower part of the upper body 1 within the lower body assembly 2.

An extension 15 of the upper body 1 provides a seating for an angular contact ball bearing 16 which locates in a recess in the main body 17 of the lower body assembly 2. The lower body assembly 2 is thus able to rotate around the upper body 1 by way of the bearings 12 and 16.

The main body 17 of the lower body assembly 2 is affixed to the casing 10 by cap screws 18.

The main body section 3 of the upper body 1 has a drilling 19 to which an air supply, for control of the lower body assembly 2, can be attached. The air passes from the drilling 19 to a 360° annulus 20 on the outer surface of the main body 3 and hence into a passage 21 in a collar 22 which is affixed to the retaining cap 13 of the lower body assembly 2. To prevent air leakage between the stationary main body 3 and the rotating collar 22 a pair of air seals 23 are fitted to the collar 22.

The lower body assembly 2 is arranged to provide support for a drill string 24. A guide piece 25 is affixed to the base 17*a* of the main body 17 and provides a lead in for the drill string 24. A recess 26 is provided in the upper part of the main body 17 to locate the upper end of the drill string 24.

Four drill string support dogs 27 are provided each rotatably mounted about a respective support pin 28. In their operating position the dogs 27 engage a shoulder 24*a* on the drill string 24 and thus hold it in position within the lower body assembly 2. The dogs 27 can be rotated out of their operating positions to allow the coupling to be lifted clear of the drill string 24.

The rotation of the dogs 27 is controlled by pneumatic cylinders 29 which are connected to the dogs 27 by operating arms 30 and pivot pins 31. To ensure smooth operation of the dogs 27 about their support pins 28 grease can be supplied to the pins 28 by grease nipples 32.

Figure 2:
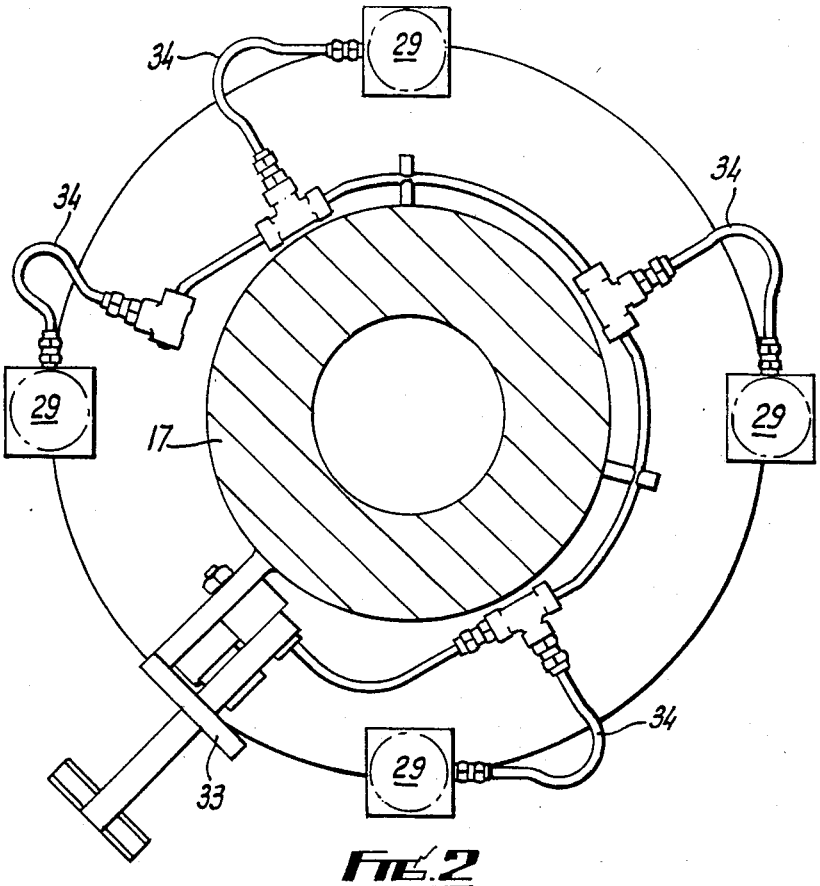
FIG. 2 is a sectional plan view, to a larger scale, of the rotating coupling of FIG. 1 taken along line AA of FIG. 1.
Figure 3:
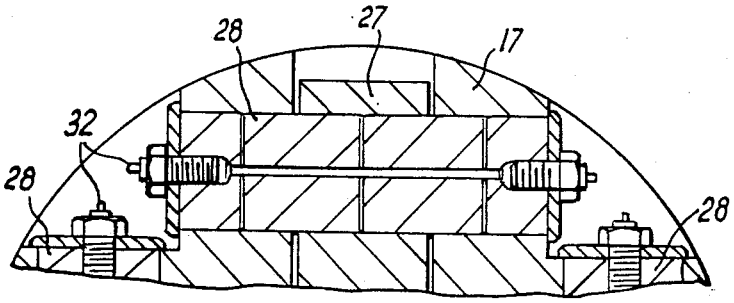
FIG. 3 is a sectional plan view, to a larger scale, of part of the rotating coupling of FIG. 1 taken along line BB of FIG. 1.

The air supply for the cylinders 29 is supplied via the drilling 19 on the upper body 1 to a four way control valve 33 (FIG. 2) from which flexible hoses 34 supply air to the cylinders 29.

In use the coupling supports a drill string 24 with the upper body 1 remaining stationary and the lower body assembly 2 being rotatable with the drill string 24.

Drilling mud is supplied to the coupling via the mud line connection 5 and travels down the bore 7 of the upper body 1 through the valve 8 and into the drill string recess 26 in the lower body assembly 2. The valve 8 has a spring return mechanism which ensures that the valve 8 closes when the mud pressure is reduced to zero. The recess 26 in the lower body has a pair of pressure activated seals 35 which prevent mud leakage around the outer diameter of the drill string 24. The valve 8 acts as a check valve if the back pressure from the well drops being designed to open when the pressure drop over the valve reaches 100 PSI. The valve spring return mechanism also ensures minimal mud loss during drill pipe break out and pipe to tool make up.

There are a number of advantages of this type of coupling.

The design of the coupling allows the circulation of mud through the drill string whilst tripping out the hole. This ensures formation pressure on the string will not cause collapse and subsequent loss.

The coupling is designed to permit rotation of the drill string. This allows the breaking out of the drill joint whilst suspending one stand of pipe above the drill floor.

The load bearing dogs 27 are in 320° angular contact with the drill string 24 thus spreading the load.

The pneumatic cylinder air control system is mounted on the body of the coupling. This allows easy access for both the derrick man and the drill floor crew thus ensuring minimum down time between racking stands of drill pipe on the most difficult of formations.

Modifications and improvements may be made without departing from the scope of the invention.

We claim:

1. A coupling for use in offshore drilling applications comprising:

an upper body;

a lower body mounted on said upper body;

support means provided on the lower body for lifting drill pipes;

a passage through the coupling for the supply of mud to the drill pipes; and valve means provided for the control of mud flow through the passage;

a recess formed in a lower portion of said lower body for receiving an upper end portion of a drill pipe;

wherein said passage is in communication with the drill pipe which is releasably retained in the recess by said support means.

2. A coupling as claimed in claim 1, wherein the valve member is in the form of a check valve mounted in a through bore of the upper body.

3. A coupling as claimed in claim 2, wherein the check valve opens when the mud pressure drop across the valve exceeds 100 PSI.

4. A coupling as claimed in claim 2, wherein an integral positive spring return seal is provided in the valve to ensure that the valve closes when the mud pressure is reduced to zero.

5. A coupling as claimed in claim 1, wherein the support means for lifting the drill pipes is in the form of a dog mounted on the lower body and rotatable between a first position in which it is in gripping contact with a drill pipe to be lifted and a second position in which it is spaced apart from said drill pipe.

6. A coupling as claimed in claim 5, wherein four dogs are provided arranged such that in their first position they are in contact with the drill pipe so as to spread the load over 320° of the diameter of the drill pipe.

7. A coupling as claimed in claim 6, wherein said dogs are each rotated between said first and second positions by means of a corresponding pneumatically operated piston and cylinder.

8. A coupling as claimed in claim 1, wherein the lower body is rotatably mounted on the upper body by one spherical thrust bearing and one angular contact bearing.

9. A coupling as claimed in claim 1, wherein two lip tight elastomeric seals are provided in the lower body to seal the lower body to the drill pipe being lifted to prevent the leakage of mud.

* * * * *